US012359431B2

(12) United States Patent
Dahl

(10) Patent No.: US 12,359,431 B2
(45) Date of Patent: Jul. 15, 2025

(54) GROUTED COUPLER FOR SPLICING STEEL REINFORCEMENT BARS

(71) Applicant: Christian L Dahl, Newport Coast, CA (US)

(72) Inventor: Christian L Dahl, Newport Coast, CA (US)

( * ) Notice: Subject to any disclaimer, the term of this patent is extended or adjusted under 35 U.S.C. 154(b) by 206 days.

(21) Appl. No.: 18/198,149

(22) Filed: May 16, 2023

(65) Prior Publication Data

US 2024/0384535 A1 Nov. 21, 2024

(51) Int. Cl.
*E04C 5/16* (2006.01)

(52) U.S. Cl.
CPC ..... *E04C 5/165* (2013.01)

(58) Field of Classification Search
CPC ..... E04C 5/165
See application file for complete search history.

(56) References Cited

U.S. PATENT DOCUMENTS 5,732,525 A * 3/1998 Mochizuki ..... E04C 5/165 52/848
5,974,761 A * 11/1999 Mochizuki ..... E04C 5/165 403/267
6,192,647 B1 * 2/2001 Dahl ..... E04C 5/165 403/300
6,679,024 B2 * 1/2004 Dahl ..... E04C 5/165 29/437
6,851,245 B1 * 2/2005 Abukawa ..... E04C 5/165 403/361
8,826,627 B2 * 9/2014 Hongo ..... E04C 5/165 52/742.16
11,732,479 B2 * 8/2023 Park ..... E04C 5/165 52/705
2009/0263185 A1 * 10/2009 Yee ..... E04C 5/165 52/741.1
2023/0265655 A1 * 8/2023 Andersen ..... F16B 7/182 52/834

* cited by examiner

*Primary Examiner* — Adriana Figueroa
(74) *Attorney, Agent, or Firm* — Morland C. Fischer

(57) ABSTRACT

Disclosed is a grouted coupler for splicing together a pair of steel reinforcement bars (i.e., rebars) that are embedded within first and second concrete members to be connected together. In one embodiment, the first rebar is connected to a first coupling cavity of the coupler within the first concrete member. A wide upset head of the second rebar that stands upwardly from the second concrete member moves through a second coupling cavity of the coupler and into a grout receiving chamber when the first concrete member is moved towards the second concrete member. The second rebar is connected to the coupler when grout is pumped into the grout receiving chamber to surround and anchor the upset head of the second rebar. A spring-biased grout removal stop is positioned within the second coupling cavity to impede the free flow of grout outwardly from the grout filled chamber.

16 Claims, 7 Drawing Sheets

GROUTED COUPLER FOR SPLICING STEEL REINFORCEMENT BARS

BACKGROUND OF THE INVENTION

1. Field of the Invention

This invention relates to a coupler for splicing together a pair of steel reinforcement bars (i.e., rebars) that are embedded within opposing concrete members in the building and construction industries so that the concrete members can be connected together to better withstand seismic and other forces. One or both of the rebars has a wide upset head that is anchored to the coupler within a chamber that is filled with a cementitious bonding material such as grout, or the like.

2. Background Art

Steel reinforcement bars (i.e., rebars) are well-known to be embedded within a reinforced concrete member (e.g., columns, beams, a wall, panel, or the like) so that the member will be less likely to shift or suffer damage caused by physical forces, such as seismic forces that are generated during an earthquake. In some cases, the rebars can become prematurely separated from their concrete members as a consequence of tensile loads applied to the rebar. In order to stabilize and retain the rebars within concrete members that are to be held together so as to better withstand tensile loads, it is known to form a wide upset head on each of the rebars that are to be joined end-to-end one another by a coupler. The upset heads create relatively large bearing surfaces by which the rebars are held in place so as to avoid their being pulled out of the coupler and separated from one another.

In this regard, what is still desirable is an improved coupler for splicing together the upset heads at opposing ends of a pair of rebars that are embedded within each of the concrete members so that the rebars will remain coupled to one another within their coupler in order to avoid the concrete members shifting in response to seismic forces. More particularly, the improved coupler should be capable of reliably anchoring the pair of rebars in end-to-end alignment therewithin while having means to prevent the rebars from being pulled out of the coupler and separating from one another.

SUMMARY OF THE INVENTION

In general terms, disclosed herein is an improved coupler for splicing together a pair of steel reinforcement bars (i.e., rebars) that are embedded within a first precast concrete member and a second opposing precast or cast-in-place concrete member. The coupler has application in the building and construction industries to enable the concrete members to be connected one to the other so as to avoid shifting in response to tensile loads such as seismic forces that are generated during an earthquake. A first of the pair of rebars is attached to the coupler that is embedded within the first concrete member, and the second of the pair of rebars is embedded within the opposing concrete member. In one coupler embodiment, both the first and second rebars are formed with a wide upset head at each end thereof. The upset head of the second rebar extends outwardly from the opposing concrete member.

The coupler includes a sleeve having first and second open ended coupling cavities located at opposite ends thereof. An intermediate grout receiving chamber is located between the first and second coupling cavities so as to communicate therewith. In the aforementioned coupler embodiment, the first rebar is inserted inwardly through the first coupling cavity and the second rebar is inserted inwardly through the second coupling cavity until the upset heads thereof are positioned end-to-end one another within the intermediate grout receiving chamber of the coupler.

A pair of spring-biased grout removal stops are hingedly connected to each of the first and second coupling cavities of the sleeve of the coupler. Each pair of grout removal stops are angled towards one another and adapted to be rotated apart from an initial locked position while at rest to a retracted position so as to allow the upset head of an incoming rebar to pass therebetween and move into the grout receiving chamber. After the upset head of each incoming rebar has passed through the space between a respective pair of grout removal stops, the stops will be biased by springs to automatically rotate towards one another from the retracted position back to their initial locked position at which to close against ribs of the incoming rebars. The stops will now be positioned to impede the free flow of grout through the grout receiving chamber and outwardly from the coupler. At this time, a liquid cementitious bonding material, such as grout or the like, is pumped into the grout receiving chamber at which to surround the upset heads of the rebars. When the bonding material dries and hardens, the upset heads will be anchored in place within the grout filled chamber to reduce the chance of the rebars separating from the coupler during an earthquake.

DESCRIPTION OF THE PREFERRED EMBODIMENT

Figure 1:
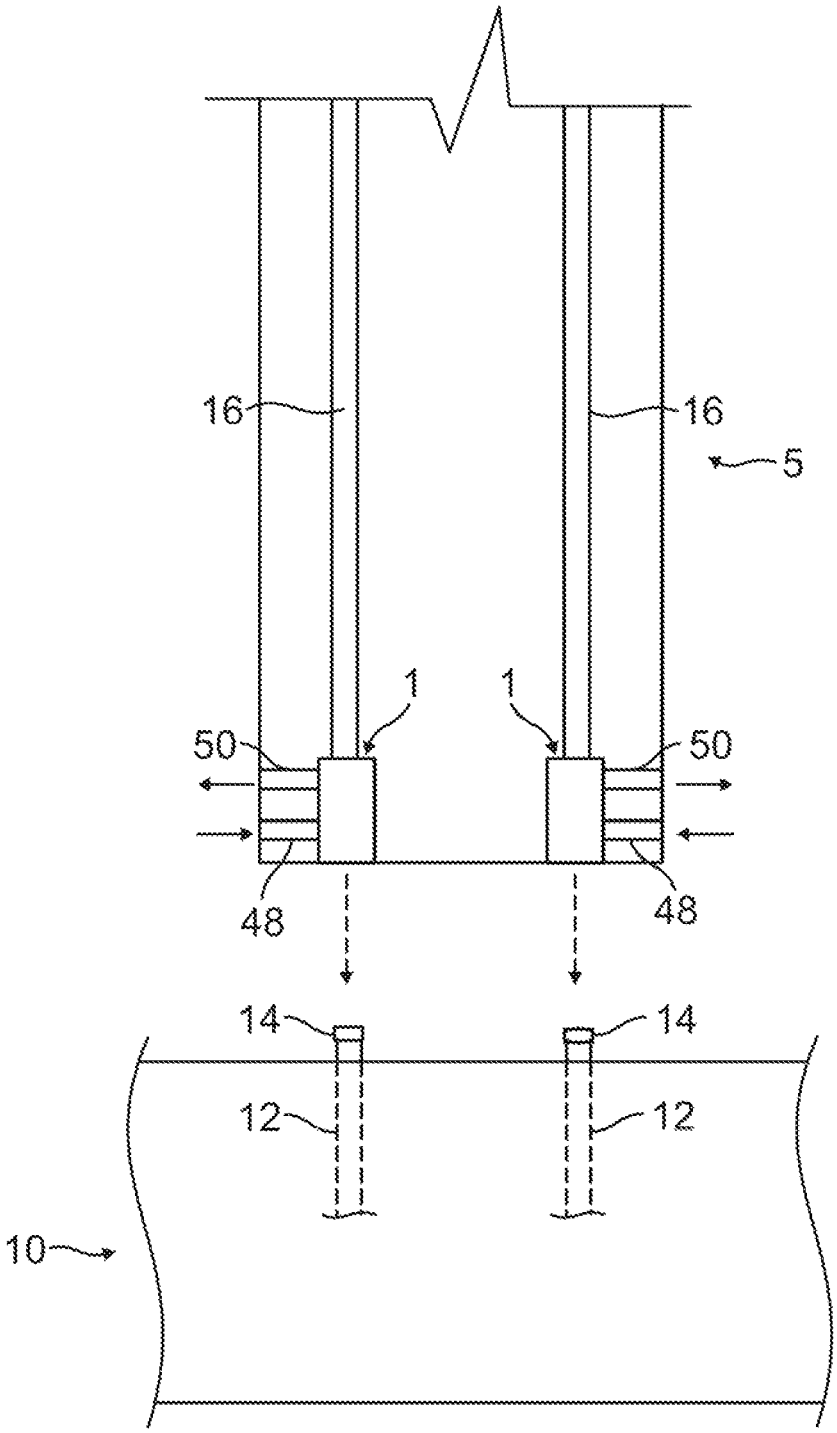
FIG. 1 illustrates environment within which grouted couplers of this invention have particular application for splicing together a pair of rebars that are embedded within opposing concrete members to be held together.

Referring to FIG. 1 of the drawings, a typical environment is illustrated in which grouted couplers of this invention to be described below have particular application. In general, one or more grouted couplers 1 as shown in FIG. 1 can be used to splice together opposing steel reinforcement bars, commonly known as rebars, for attaching concrete elements one to another in the construction or building industry. By way of example only, an upper precast concrete member 5 such as a block or column is shown being lowered into alignment with and connection atop a lower precast-in-place concrete member 10 such as a footing or foundation for a wall.

The lower concrete footing member 10 has a number of reinforcement bars 12 embedded therewithin and protruding upwardly therefrom. Each reinforcement bar 12 has a wide (i.e., upset) head 14 formed at the top thereof which is accessible above the lower concrete member 10. The upper concrete member 5 has a corresponding number of reinforcement bars 16 embedded therewithin and attached to respective grouted couplers 1 to be joined to the upset heads 14 of the reinforcement bars 12 by which to securely hold the upper column member 5 in place atop the lower footing member 10. The couplers 1 and the reinforcement bars 16 attached thereto are embedded during the casting of the upper concrete member 5. Although the reinforcement bars 12 and 16 are shown running vertically through concrete members 5 and 10, the couplers to be described herein may also be used for splicing reinforcement bars that run horizontally.

As will soon be described, each reinforcement bar 16 that is embedded within the upper concrete member 5 may also be formed with a wide (i.e., upset) head (not shown) to be spliced by means of the grouted coupler 1 to an opposing upset head 14 from a reinforcement bar 12 that stands upwardly from the lower concrete member 10. By virtue of the grouted couplers herein disclosed, concrete breakout failures are less likely to occur, and the straight pull-out capacity of the reinforcement bars can be advantageously increased. What is more, the length of the coupler can be sized to provide a relatively short splice when compared with the length of conventional couplers so as to enhance the seismic capability of the coupler.

Figure 2:
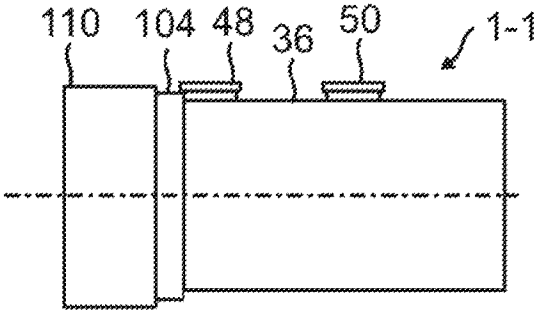
FIG. 2 shows a first embodiment for a grouted coupler of this invention.
Figure 3:
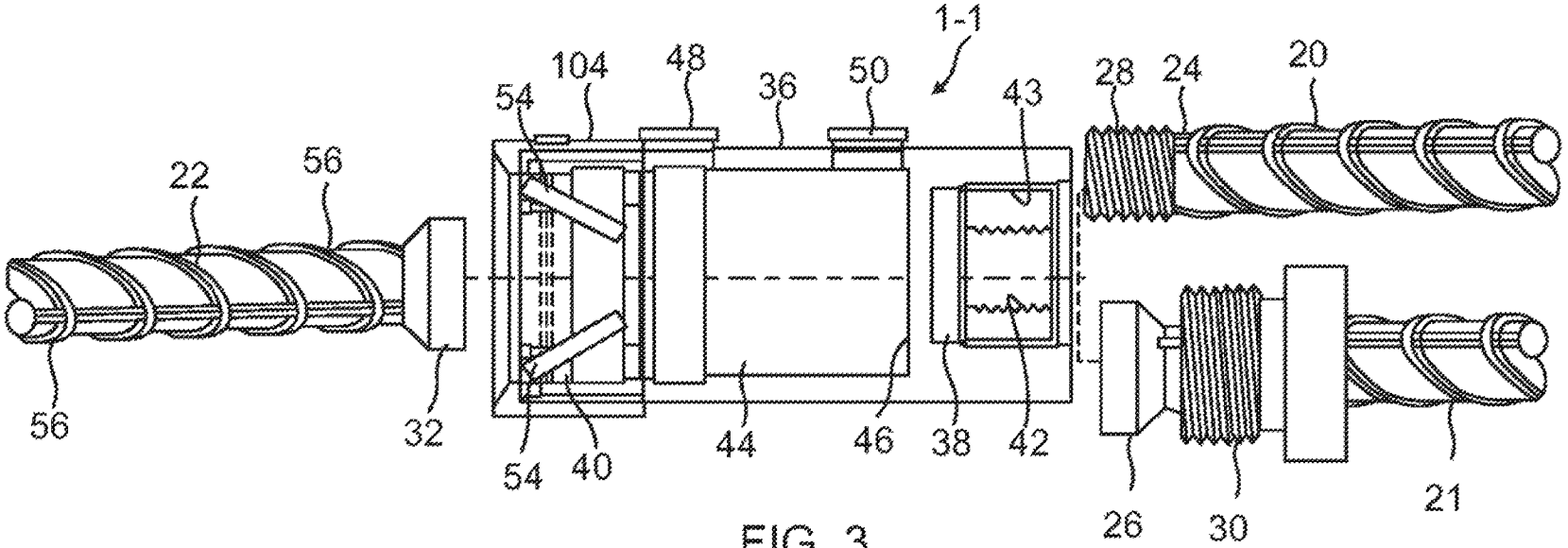
FIG. 3 shows first and second rebars to be spliced together being received by respective first and second coupling cavities located at opposite ends of the coupler of FIG. 2 wherein pairs of spring-biased grout removal stops are located to engage the rebars.
Figure 4:
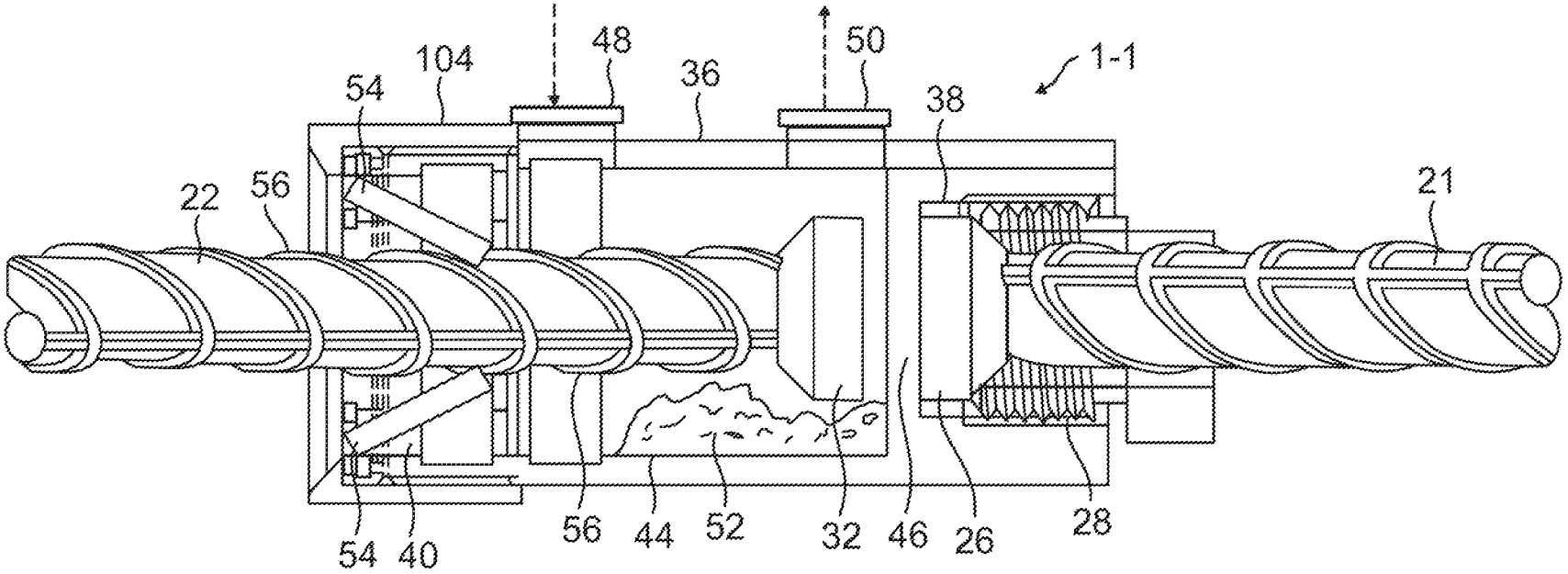
FIG. 4 shows the first and second rebars of FIG. 3 moved inwardly through the first and second coupling cavities and positioned end-to-end one another within the coupler of FIG. 2 at which to be engaged by respective pairs of the grout removal stops of FIG. 3 so as to impede the flow of grout outwardly from the coupler.

Turning to FIGS. 2-4 of the drawings, a first grouted coupler 1-1 is shown for axially aligning and splicing together a pair of reinforcement bars (i.e., rebars) that are embedded within opposing precast concrete members such as those shown in FIG. 1 and designated by the reference numerals 5 and 10. However, the grouted coupler 1-1 may also be used for splicing rebars in cast-in-place concrete applications. As is best shown in FIG. 2, a first rebar 20 or 21 that is embedded within and extends longitudinally through the upper concrete member 5 to be attached to one end of the coupler 1-1 can have either a straight incoming end 24 (for rebar 20) or an upset (i.e., headed) incoming end 26 (for rebar 21). In either case, each rebar 20 and 21 has a set of screw threads 28 and 30 running around the incoming end thereof. A second rebar 22 that is embedded within the lower concrete member 10 to be attached to the opposite end of coupler 1-1 has an upset (i.e., headed) incoming end 32. As is best shown in FIG. 1, the second rebar 22 (designated 12 in FIG. 1) projects outwardly from and above the top of the lower concrete member 10 so that the upstanding head 32 thereof (designated 14 in FIG. 1) is available to be attached to the coupler 1-1.

The grouted coupler 1-1 of FIGS. 2-4 is generally a cylindrical sleeve 36 having a first open-ended coupling cavity 38 located at one end thereof and a second open-ended coupling cavity 40 located at the opposite end. A set of screw threads 42 runs around the inside of the first coupling cavity 38 to which the screw threads 28 of the straight incoming end 24 of rebar 20 will be mated. In the case where the headed rebar 21 is used in place of rebar 20, a different set of screw threads 43 will be formed around the first coupling cavity 38 to which the screw threads 30 of rebar 21 will otherwise be mated. An intermediate grout receiving chamber 44 is located within the sleeve 36 of the grouted coupler 1-1 between the first and second coupling cavities 38 and 40. A rebar retaining wall 46 runs through the cylindrical sleeve 36 so as to lie between the first coupling cavity 38 and the grout receiving chamber 44. The second coupling cavity 40 of sleeve 36 is axially aligned and communicates with the grout receiving chamber 44. Grout inlet and outlet ports 48 and 50 communicate with the grout receiving chamber 44 through the sleeve 36 of the grouted coupler 1-1 to establish flow paths through which grout or a similar bonding material (designated 52 in FIG. 4) can fill chamber 44 and allow any overflow grout to exit the chamber.

As is best shown in FIG. 4, the first rebar 21 within the upper concrete member (designated 5 in FIG. 1) is attached to the grouted coupler 1-1 that is embedded within column member 5 by sliding the incoming headed end 26 of rebar 21 into the open-ended first coupling cavity 38 of the sleeve 36. However, as was previously explained, the rebar 20 having a threaded straight end 28 can be substituted for the rebar 21. In the case where the rebar 21 is to be attached to the coupler 1-1, and prior to casting, the threads 30 that run around the rebar 21 are rotated into mating engagement with the threads 43 that will be formed around the first coupling cavity 38, whereby the first rebar 21 is connected in place to the sleeve 36.

The upper concrete member 5 is now lowered towards the lower concrete member 10 such that the upset head 32 at the incoming end of a second rebar 22 that projects upwardly from the lower member slides into and through the open-ended second coupling cavity 40 of the sleeve 36 of the grouted coupler 1-1. The second rebar 22 continues to slide through the intermediate grout receiving chamber 44 until the headed ends 26 and 32 of the first and second rebars 21 and 22 to be spliced together lie end-to-end one another at opposite sides of the rebar retaining wall 46 by which to prevent any further displacement of the rebars through the sleeve 36 of the coupler 1-1.

As an important feature of the grouted coupler 1-1 herein disclosed, a set of two or more spring-biased grout removal stops 54 are hingedly attached at first ends thereof to the open-ended second coupling cavity 40 of the sleeve 36 through which the incoming headed end 32 of the second rebar 22 is slidably received. The grout removal stops are preferably manufactured from steel. A pair of the grout removal stops 54 are shown in FIG. 3 in a locked position extending from their first ends inwardly towards one another from the open end of the second coupling cavity 40 such that an angle of about 90 degrees is formed between outstretched opposite ends of the stops 54. The outstretched opposite ends of the spring-biased grout removal stops 54 are adapted to rotate outwardly and away from one another within the second coupling cavity 40 to a retracted position in response to the upset head 32 of the second rebar 22 moving therebetween and applying a pushing force thereto. Accordingly, the diameter of the upset head 32 of die incoming rebar 22 must be greater than the space between the outstretched ends of the pair of stops 54 in their at-rest locked position.

FIG. 4 shows the first and second rebars 21 and 22 in end-to-end alignment with one another to be spliced together by the grouted coupler 1-1 when the upset head 26 of the first rebar 21 is slidably received within the first coupling cavity 38 and the upset head 32 of the second rebar 22 is slidably received within the grout receiving chamber 44. In this case, at least the second rebar 22 is surrounded by a plurality of ribs 56 that are spaced from one another along the longitudinal axis of rebar 22. As the incoming second rebar 22 slides through the second coupling cavity 40, the relatively wide diameter of the head 32 causes the outstretched ends of the pair of spring-biased grout removal stops 54 to rotate in an outward direction from their at-rest locked position as shown so as to be pushed away and be separated from one another to their retracted position in order to accommodate the upset head 32 of the rebar 22 through the enlarged space therebetween.

Once the wide upset head 32 of the second rebar 22 moves through the second coupling cavity 40 and into the grout receiving chamber 44, the pair of spring-biased stops 54 will be urged by springs (designated 98 and best shown in FIG. 8) to automatically rotate in an opposite inward direction so as to be pushed towards one another and move back to their initial locked position at which to close against the rebar 22. After being pushed towards one another, the outstretched ends of the stops 54 will engage the ribs 56 surrounding the rebar 22 to provide a bearing surface that impedes the flow of the grout through the grout receiving chamber 44. It may therefore be appreciated that in their at-rest closed and locked position, the outstretched ends of the grout removal stops 54 create a grout flow stop.

With the second rebar 22 held in axial alignment with the opposing first rebar 21 within the sleeve 36, a supply of liquid cementitious bonding material (designated 52 in FIG. 4), such as grout, epoxy, or the like, is pumped through the grout inlet port 48 to fill the grout receiving chamber 44 of the grouted coupler 1-1. Any overflow grout can exit the grout receiving chamber 44 by way of the grout outlet port 50. The grout within the grout filled chamber 44 surrounds the upset head 32 of the second rebar 22 that is received within the chamber 44. Thus, once the grout dries and hardens, the upset end 32 of rebar 22 is anchored within the grout filled receiving chamber 44, and a continuous coupling connection is established by which to splice the opposing rebars 21 and 22 together. What is more, the stop provided by the pair of spring-biased grout removal stops 54 reduces the flow of the grout out of the grouted coupler 1-1 by which the coupler is better able to resist seismic and other forces that could otherwise cause the upper concrete member (5 of FIG. 1) to shift relative to the lower concrete member (10 of FIG. 1).

Figure 5:
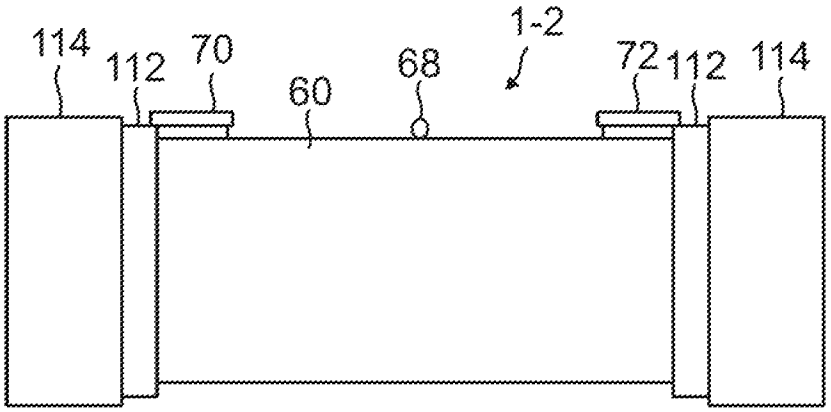
FIG. 5 shows a second embodiment for a grouted coupler of this invention.
Figure 6:
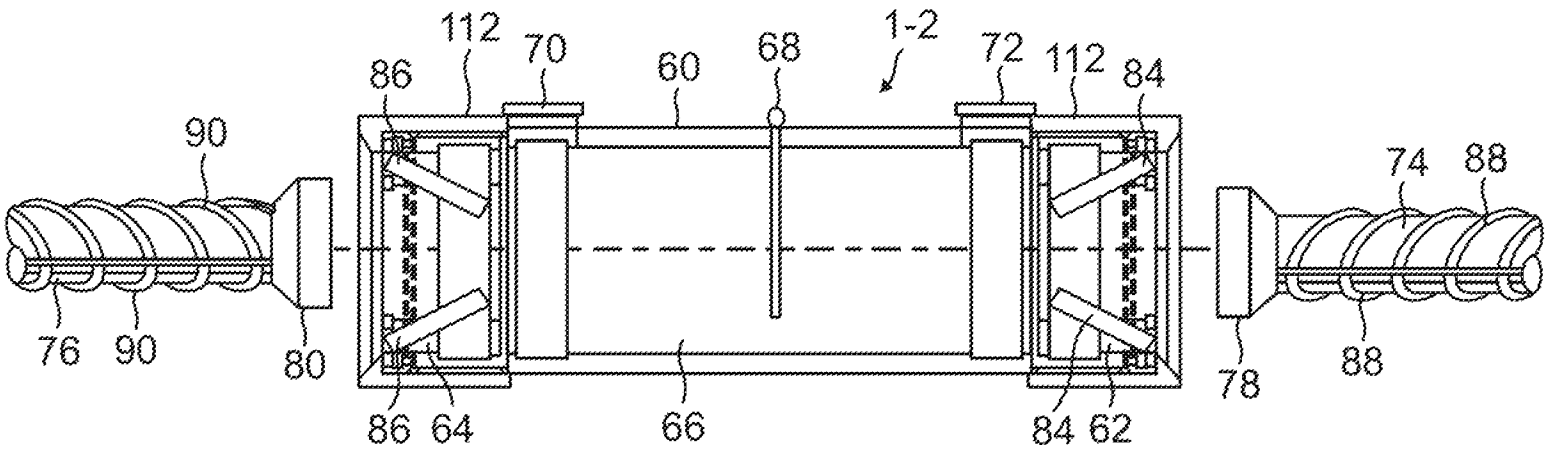
FIG. 6 shows first and second rebars to be spliced together being received by respective first and second coupling cavities located at opposite ends of the coupler of FIG. 5 wherein pairs of spring-biased grout removal stops are located to engage the rebars.
Figure 7:
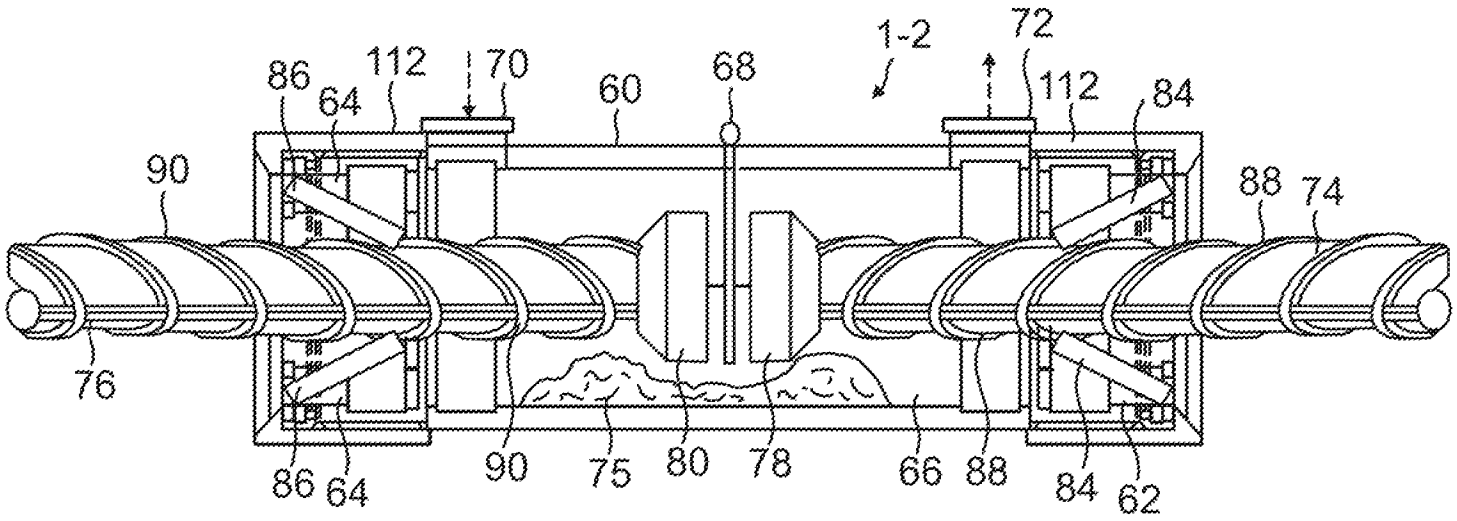
FIG. 7 shows the first and second rebars of FIG. 6 after being moved inwardly through the first and second coupling cavities of the coupler of FIG. 5 and positioned end-to-end one another within an intermediate grout receiving chamber that lies between the first and second coupling cavities.

Turning now to FIGS. 5-7 of the drawings, a modified grouted coupler 1-2 is shown. Like the grouted coupler 1-1 of FIGS. 2-4, the grouted coupler 1-2 is a generally cylindrical sleeve 60 having a first open-ended coupling cavity 62 located at one end thereof and a second open-ended coupling cavity 64 located at the opposite end in axial alignment with the first coupling cavity 62. An intermediate grout receiving chamber 66 is located within the sleeve 60 of the grouted coupler 1-2 between the first and second coupling cavities 62 and 64. Rather than the rebar retaining wall 46 of the coupler 1-1, a removable rebar locating pin 68 is pushed through the cylindrical sleeve 60 to lie in the middle of the grout receiving chamber 66. Grout inlet and outlet ports 70 and 72 communicate with the grout receiving chamber 66 through the sleeve 60 of the grouted coupler 1-2 to establish flow paths through which grout or a similar bonding material (designated 75 in FIG. 7) can be pumped into and flow out of chamber 66.

As shown in FIG. 6, first and second rebars 74 and 76 are moved inwardly through the open-ended coupling cavities 62 and 64 at opposite ends of the sleeve 60 of coupler 1-2. Each rebar is provided with a relatively wide upset head 78 and 80 at the incoming end thereof. As was previously explained, the first rebar 74 is typically embedded within a first (e.g., upper) concrete member like that designated 5 in FIG. 1, and the second rebar 76 is typically embedded within an opposing second (e.g., lower) concrete member like that designated 10 in FIG. 1, such that the upset head 80 of rebar 76 stands upwardly from concrete member 10. The upper concrete member within which the first rebar 74 is attached to the grouted coupler 1-2 is lowered towards the lower concrete member 10 from which the upset head 80 of the second rebar 76 projects.

The upper concrete member 5 moves against the top of the lower concrete member 10 until the upset head 80 of the incoming end of the second rebar 76 that stands upwardly from the lower concrete member 10 slides through the open-ended second coupling cavity 64 of the sleeve 60 of coupler 1-2 and into the grout receiving cavity 66. The rebar 76 continues to slide through sleeve 60 until the upset heads 78 and 80 of the first and second rebars 74 and 76 to be spliced together lie end-to-end one another and in contact with the rebar locating pin 68. The presence of the rebar locating pin 68 provides an indication to workmen when the rebars 74 and 76 are ideally located within the sleeve 60 of coupler 1-2 with the upset heads 78 and 80 lying at the middle of the grout receiving chamber 66. At this point, the rebar locating pin 68 is withdrawn from the sleeve 60.

The grouted coupler 1-2 has sets (e.g., pairs) of spring-biased grout removal stops 84 and 86 hingedly connected at respective first ends thereof to each one of the open-ended first and second coupling cavities 62 and 64 of the sleeve 60 through which the incoming headed ends 78 and 80 of the first and second rebars 74 and 76 are slidably received. Each rebar 74 and 76 is surrounded by a plurality of ribs 88 and 90 that are spaced from one another along the longitudinal axes of the rebars 74 and 76. As in the case of the grout removal stops 54 of the coupler 1-1, outstretched opposite ends of each pair of grout removal stops 84 and 86 of coupler 1-2 are initially positioned in a locked position while at-rest extending inwardly from their first ends towards one another such that an angle of about 90 degrees is formed between the outstretched opposite ends.

Each of the pairs of spring-biased grout removal stops 84 and 86 is adapted to rotate outwardly and away from one another within the first and second coupling cavities 62 and 64 from their at-rest locked position as shown to a retracted position in response to the wide upset heads 78 and 80 of the incoming first and second rebars 74 and 76 moving between the outstretched ends of the stops. In this regard, and as is best shown in FIG. 7, the outstretched ends of the pairs of spring-biased grout removal stops 84 and 86 are pushed away and separated from one another to accommodate the wide upset heads 78 and 80 through the enlarged space therebetween. Once the first and second rebars 74 and 76 have been positioned in end-to-end alignment with one another within the grout receiving chamber 66, the outstretched ends of the pairs of spring-biased grout removal stops 84 and 86 and urged by the springs 98 shown in FIG. 8 to automatically rotate in an opposite inward direction from their retracted position back to their initial locked position to be pushed towards one another and close against the rebars 74 and 76. After being pushed towards one another, the pairs of grout removal stops 84 and 86 will be ideally positioned to impede the free flow of grout outwardly from the grout receiving chamber 66 and through the first and second coupling cavities 62 and 64 whereby to reduce the chance of the grout flowing out of coupler 1-2.

With the first and second rebars 74 and 76 held in axial alignment with one another and the upset heads 78 and 80 lying end-to-end within the grout receiving chamber 66 of the grouted coupler 1-2, a supply of liquid cementitious bonding material 75 such as grout, epoxy, or the like, is pumped through the grout inlet port 70 to fill the grout receiving chamber 66. Any overflow grout can exit the grout receiving chamber 66 by way of the grout outlet port 72. The grout within the grout filled chamber 66 surrounds each of the upset heads 78 and 80 of the first and second rebars 74 and 76. Thus, when the grout dries and hardens, the upset heads 78 and 80 of rebars 74 and 76 are anchored within the grout filled chamber 66, and a continuous coupling connection is established by which to splice the opposing rebars 74 and 76 together.

Figure 8:
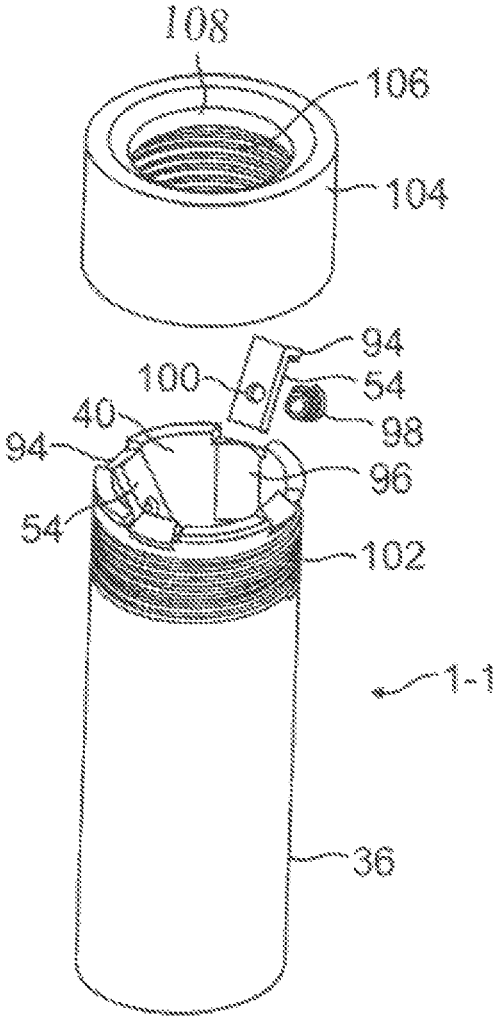
FIGS. 8-10 show details of spring-biased grout removal stops positioned to engage the first and second rebars so as to impede the flow of grout through the intermediate grout receiving chamber and outwardly from the coupler of FIG. 5.
Figure 9:
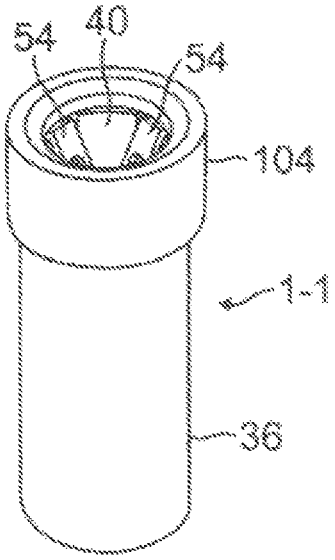
Figure 10:
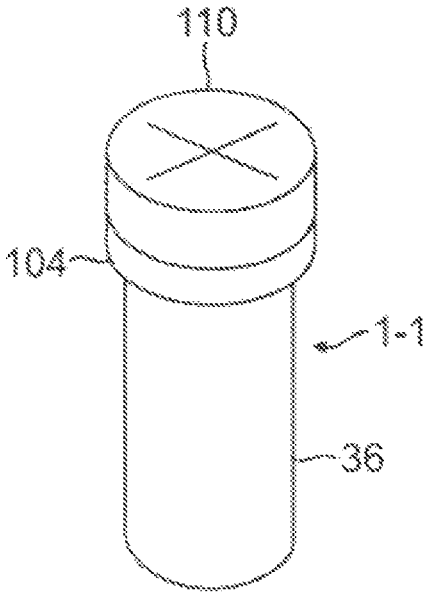

FIGS. 8-10 of the drawings show details of the spring-biased grout removal stops 54 that are located within the open-ended second coupling cavity 40 at one end of the cylindrical sleeve 36 of the grouted rebar coupler 1-1 of FIGS. 2-4. As was previously explained, a first end 94 of each grout removal stop 54 is attached to the sleeve 36 so that the opposite outstretched end thereof is adapted to be rotated between a locked position while at-rest to a retracted position in response to the upset head of a rebar (designated 22 in FIG. 4) moving into the second coupling cavity 40 and between the stops 54.

Each of the grout removal stops 54 is manufactured from a solid (e.g., steel) material that is adapted to rotate outwardly within the coupling cavity 40 from the locked position as shown to the retracted position. In this regard, and as is best shown in FIG. 8, the first ends 94 of the spring-biased grout removal stops 54 have hooks that are hingedly attached around the sleeve 36 at the open end of the second coupling cavity 40. The outstretched opposite ends of the stops 54 are located above respective pockets 96 that are recessed within the sleeve 36.

One end of a (e.g., coil) spring 98 is fastened to the outstretched end of each grout removal stop 54 through a hole 100 formed therein. The opposite end of spring 98 lies against the pocket 96 that is recessed in the sleeve 36 adjacent the open end of the second coupling cavity 40. Accordingly, the springs 98 are compressed when the stops 54 rotate outwardly for receipt within pockets 96 to the retracted position. Thus, when the wide head (designated 32 in FIG. 4) of the incoming rebar 22 moves past the spring-biased grout removal stops 54 and through the second coupling cavity 40, the springs 98 will expand and thereby urge the outstretched ends of the stops 54 to automatically rotate inwardly towards one another from the retracted position to their locked position.

As was previously explained while referring to FIG. 4, when the grout removal stops 54 rotate back to their at-rest locked position, the outstretched ends thereof close against the incoming rebar 22 at which to be ideally positioned so as to impede the free flow of grout through the second coupling cavity 40 and outwardly from the coupler 1-1.

A set of threads 102 surround the sleeve 36 of coupler 1-1 below the open end of coupling cavity 40. A cylindrical collar 104 having a complementary set of threads 106 is rotated into mating engagement with the threads 102 of sleeve 36 (best shown in FIG. 9) such that the collar 104 surrounds de coupling cavity 40 within the sleeve 36. The collar 104 holds the spring-biased grout removal stops 54 in place with the first ends thereof hingedly attached to the sleeve 36 and the opposite out stretched ends spaced above respective recessed pockets 96. A rebar entrance hole 108 extends longitudinally through the cylindrical collar 104 to accommodate the incoming rebar 22 for receipt by the coupling cavity 40.

As shown in FIG. 10, a (e.g., plastic) end cap 110 is attached in surrounding engagement to the second coupling cavity 40 at one end of the sleeve 36 of the grouted rebar coupler 1-1. The end cap 110 prevents dirt and other debris from entering the coupler 1-1 prior to its use. The end cap 110 is scored in order to enable the incoming rebar 22 to pass therethrough to be connected to the coupler via the rebar entrance hole 108 through collar 104.

FIGS. 8-10 show one set of spring-biased grout removal stops 54 located within the coupling cavity 40 at one end of the sleeve 36 of coupler 1-1. However, it is to be expressly understood that the teachings of this invention are also applicable to the grout removal stops 84 and 86 located within the first and second coupling cavities 62 and 64 at opposite ends of the sleeve 60 of the coupler 1-2 of FIGS. 5-7. In this case, and as is best shown in FIG. 5, the coupling cavities 62 and 64 and the stops 84 and 86 therewithin are surrounded by respective threaded collars 112 which are covered by respective removable end caps 114.

Figure 11:
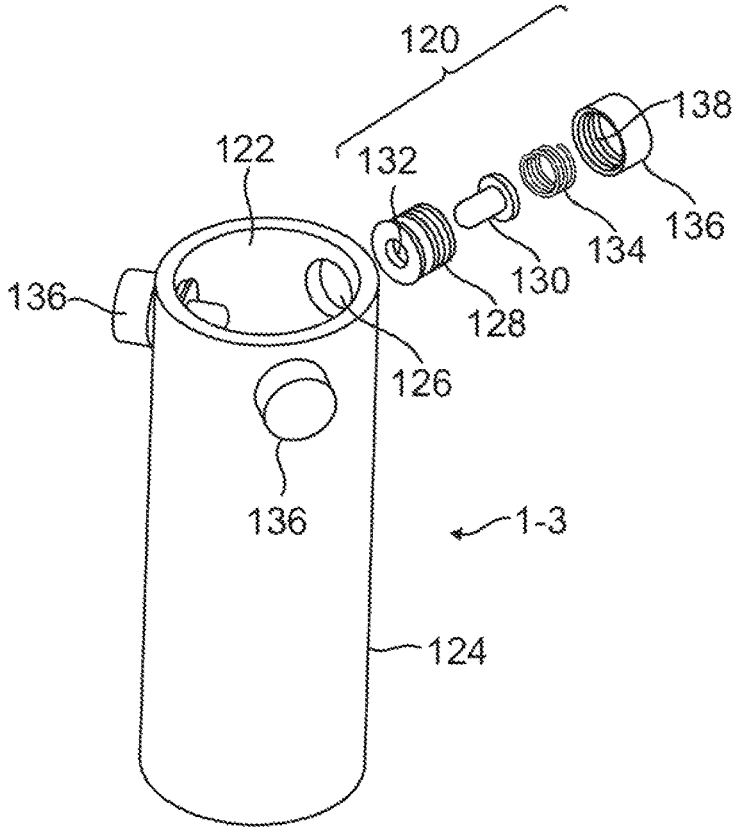
FIGS. 11-13 show details of push-button operated grout removal stops adapted to engage one of the rebars of the coupler shown in FIG. 2 so as to impede the flow of grout outwardly from the coupler.
Figure 12:
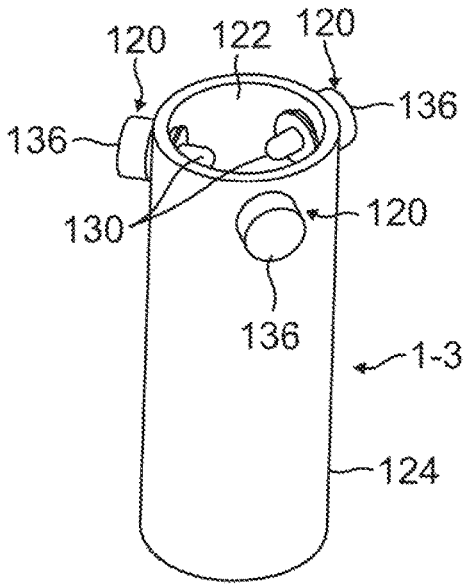
Figure 13:
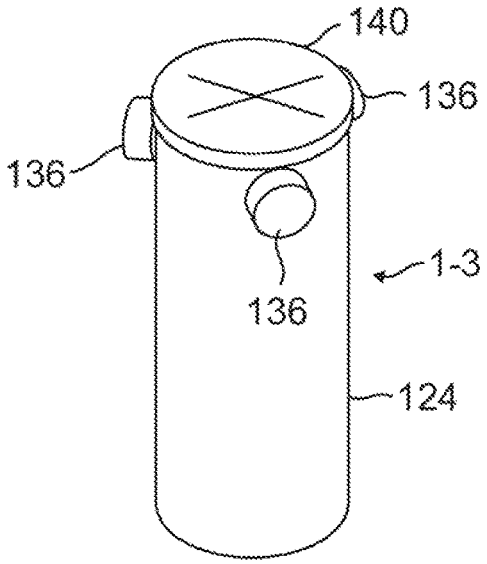

FIGS. 8-10 show the grouted rebar coupler 1-1 having grout removal stops 54 located at one end thereof by which to engage a rebar 22 and impede the flow of grout outwardly from a coupling cavity 40 within which the rebar is received. FIGS. 11-13 of the drawings show a rebar coupler 1-3 having push-button operated grout removal stops 120 which may be used in place of the stops 54. In this case, a set of three grout removal stops 120 are attached to the open-ended coupling cavity 122 at one end of the cylindrical sleeve 124 of the coupler 1-3. The grout removal stops 120 are uniformly spaced from one another and attached to the sleeve 124 at holes 126 formed therethrough.

Each of the push-button operated grout removal stops 120 includes a threaded push-button receptacle 128 having a wide lip and a threaded cylindrical body. Each push-button receptacle 128 is pushed outwardly through a respective one of the holes 126 formed in the sleeve 124. A spring-biased push-button 130 is pressed into a hole 132 that is formed in the push-button receptacle 128 so as to extend through receptacle 128 and into the coupling cavity 122 (best shown in FIG. 12). A (e.g., coil) spring 134 lays on top of the push-button 130, and a cylindrical spring collar 136 having a closed top and threads 138 running around an open interior thereof is mated in surrounding engagement to the threaded body of the push-button receptacle 128 to retain the push-button receptacle 128 within the hole 126 and hold the spring 134 in place against the push-button 130. Thus, the spring 134 will initially lie at-rest in a relaxed state between the push-button 130 and the closed top of the spring collar 136. A (e.g., plastic) end cap 140 is attached in surrounding engagement to the coupling cavity 122 at one end of the sleeve 124 of rebar coupler 1-3. The end cap 140 is scored to enable an incoming rebar to pass therethrough for receipt within the coupling cavity 122.

The spring-biased push-buttons 130 of the grout removal stops 120 of the coupler 1-3 are adapted to be depressed so as to move radially outward from the cylindrical sleeve 124 through the holes 132 in the push-button receptacles 128 in response to the receipt of a headed rebar, such as that shown in FIG. 3 and designated 22, within the coupling cavity 122. An outward movement of the push-buttons 130 from their at-rest position within the coupling cavity 122 as shown in FIG. 12 to a retracted position lying outside the coupling cavity (not shown) will cause the spring 134 to be compressed between the spring-biased push-buttons 130 and the spring collars 136.

When the upset head 32 of the incoming rebar 22 moves past the push-buttons 130, the formerly compressed springs 134 are permitted to expand from their retracted position back to their initial at-rest position within the sleeve 124. The inwardly extending push-buttons 130 will now engage the wide head 32 at which to be ideally positioned so as to impede the free flow of grout through the coupling cavity 122 and outwardly from the coupler 1-3.

The grouted couplers 1-1, 1-2 and 1-3 of this invention enable a pair of opposing concrete elements such as those designated 5 and 10 in FIG. 1 to be reliably connected together and properly aligned one above the other so as to avoid shifting during an earthquake. Pumping a liquid cement (e.g., grout or epoxy) into the intermediate grout receiving chamber creates a high strength and long lasting bond between the rebars and their coupler which is effective to enable the concrete members that are to be held together to better withstand both tension and compression forces. The formation of enlarged upset heads at the opposing ends of the rebars creates bearing surfaces that enable the rebars to be joined to one another in a manner that advantageously allows the splice length to be reduced, such that once the liquid bonding material has hardened, the rebars and their coupler function as a continuous mechanical splice without the necessity of any intervening joint.

The invention claimed is:

1. A coupler and first and second rebars to be spliced to one another by said coupler where each of said first and second rebars has a first end and an opposite end and said first rebar has an upset head at the first end thereof that is wider than the opposite end, said coupler comprising:

a first rebar input through which the upset head at the first end of said first rebar is received;

a second rebar input through which the first end of said second rebar is received, said second rebar being connected to the coupler at said second rebar input thereof;

an intermediate chamber located between said first and second rebar inputs and communicating with said first rebar input such that said first rebar moves through said first rebar input and the upset head at the first end of said first rebar is received within said intermediate chamber;

a supply of liquid cementitious bonding material with which to fill said intermediate chamber and surround the upset head at the first end of said first rebar that is received within said intermediate chamber, such that when said liquid cementitious bonding material dries and hardens, said upset head is anchored within said intermediate chamber and said first and second rebars are spliced to one another; and a pair of grout removal stops having first ends pivotally connected to said first rebar input and opposite ends being angled towards one another to engage the opposite end of said first rebar therebetween so as to impede the flow of grout through said intermediate chamber and outwardly from said coupler by way of said first rebar input.

2. The coupler recited in claim 1, wherein said supply of liquid cementitious bonding material is grout.

3. The coupler recited in claim 2, wherein said coupler further comprises grout inlet and grout outlet ports communicating with said intermediate chamber, said grout being pumped into said intermediate chamber by way of said grout inlet port so as to surround the upset head at the first end of said first rebar, and said grout flows out of said intermediate chamber by way of said grout outlet port.

4. The coupler recited in claim 1, wherein the second rebar input has a set of threads running therearound and the first end of said second rebar has a complementary set of threads running therearound to be mated to the threads of said second rebar input, whereby the first end of said second rebar is connected to said coupler at the second rebar input.

5. The coupler recited in claim 1, wherein the first end of said second rebar has an upset head that is wider than the opposite end thereof, the upset head of said second rebar being held within said second rebar input so as to lie opposite the upset head of said first rebar when said second rebar is connected to said coupler at said second rebar input.

6. The coupler recited in claim 1, wherein the opposite ends of the pair of grout removal stops of said grout stop are rotatable with respect to one another between a locked position at which said opposite ends are closed around the opposite end of said first rebar and a retracted position at which said opposite ends are moved apart and separated from one another by a space that is larger than the upset head at the first end of said first rebar.

7. The coupler recited in claim 6, wherein said grout stop also includes a spring lying between the opposite end of each of the pair of grout removal stops and said first rebar input such that the opposite ends of said pair of grout removal stops are urged by said springs to automatically rotate rom said retracted position to said locked position after the upset head of said first rebar moves through said first rebar input and into said intermediate chamber.

8. The coupler recited in claim 6, wherein the opposite end of said first rebar has a plurality of ribs running therearound and extending longitudinally therealong, the opposite ends of the pair of grout removal stops of said grout stop closing around the opposite end of said first rebar and engaging some of the plurality of ribs when said opposite ends are rotated to said locked position.

9. A coupler and first and second rebars to be spliced to one another by said coupler where each of said first and second rebars has a first end and an opposite end and each of said first and second rebars has an upset head at the first end thereof that is wider than the opposite end, said coupler comprising:

a first rebar input through which the first end of said first rebar is received;

a second rebar input through which the first end of said second rebar is received;

an intermediate chamber located between and communicating with each of said first and second rebar inputs, such that said first and second rebars move through said first and second rebar inputs and the upset heads at the first ends of said first and second rebars are located end-to-end one another within said intermediate chamber;

a supply of liquid grout with which to fill said intermediate chamber and surround the upset heads at the first ends of said first and second rebars that are received within said intermediate chamber, such that when said liquid grout dries and hardens, said upset heads are anchored within said intermediate chamber and said first and second rebars are spliced to one another; and a grout stop located within each of the first and second rebar inputs, wherein each grout stop includes a pair of grout removal stops having first ends pivotally connected to one of said first or second rebar inputs and opposite ends being angled towards one another to engage the opposite end of one of said first or second rebars therebetween so as to impede the flow of grout through said intermediate chamber and outwardly from said coupler by way of the first and second rebar inputs thereof.

10. The coupler recited in claim 9, wherein said coupler further comprises inlet and outlet ports communicating with said intermediate chamber, said liquid cementitious bonding material being pumped into said intermediate chamber by way of said inlet port so as to surround the upset heads at the first ends of said first and second rebars, and said liquid cementitious bonding material flows out of said intermediate chamber by way of said outlet port.

11. The coupler recited in claim 9, further comprising a removable rebar locating pin extending through said intermediate chamber to lie between the upset heads at the first ends of said first and second rebars and provide an indication of the location of said upset heads within said intermediate chamber.

12. The coupler recited in claim 9, wherein the opposite ends of each of the pairs of grout removal stops are rotatable with respect to one another between a locked position at which said opposite ends are closed around the opposite ends of respective ones of said first and second rebars and a retracted position at which said opposite ends of the pairs of grout removal stops are moved apart and separated from one another by a space that is larger than the upset heads at the first ends of said first and second rebars.

13. The coupler recited in claim 12, wherein the first ends of the pairs of grout removal stops are hingedly connected to respective ones of said first and second rebar inputs by springs such that the opposite ends of said pairs of grout removal stops are urged by said springs to automatically rotate from said retracted position to said locked position after the upset heads of said first and second rebars move through said first and second rebar inputs and into said intermediate chamber.

14. The coupler recited in claim 12, wherein each of the opposite ends of each of said first and second rebars has a plurality of ribs running therearound and extending longitudinally therealong, the opposite ends of the pairs of grout removal stops closing around respective ones of the opposite ends of said first and second rebars and engaging some of the plurality of ribs thereof after the opposite ends of said pairs of grout removal stops are rotated to said locked position.

15. A coupler and first and second rebars to be spliced to one another by said coupler where the first rebar has first and opposite ends and an upset head at the first end that is wider than the opposite end, said coupler comprising:

a rebar input through which the upset head of the first rebar is received to be spliced to the second rebar;

a pair of grout removal stops connected to said rebar input and being movable relative to said rebar input towards and away from one another between a first position spaced from the first rebar within said rebar input to a second position at which to engage the opposite end of the first rebar;

springs communicating with respective ones of said pair of grout removal stops and expanding so as to urge said pair of stops to move from said first position towards said second position and into engagement with the opposite end of the first rebar; and a liquid cementitious bonding material supplied to said rebar input to surround the upset head at the first end of said first rebar that is received within said rebar input, said pair of grout removal stops impeding the flow of the bonding material through said rebar input and outwardly from said coupler when said springs expand and said pair of grout removal stops move to said second position lying in engagement with the opposite end of the first rebar.

16. The coupler recited in claim 15, wherein said pair of grout removal stops include respective push-buttons that are movable into said rebar input and towards one another so as to engage the opposite end of the first rebar when said springs expand and said grout removal stops move from said first position to said second position.

* * * * *